US005656311A

United States Patent [19]

Fond

[11] Patent Number: 5,656,311

[45] Date of Patent: Aug. 12, 1997

[54] CARTRIDGES HAVING INTERIORLY POSITIONED ZONES OF REDUCED THICKNESS

[75] Inventor: Olivier Fond, Yverdon, Switzerland

[73] Assignee: Nestec S.A., Vevey, Switzerland

[21] Appl. No.: 428,512

[22] Filed: Apr. 25, 1995

Related U.S. Application Data

[63] Continuation of Ser. No. 899,342, Jun. 16, 1992, abandoned.

[30] Foreign Application Priority Data

Jul. 5, 1991 [EP] European Pat. Off. ..... 91111213

[51] Int. Cl.[6] ..... B65D 85/00; B65D 81/34

[52] U.S. Cl. ..... 426/84; 426/77; 426/112

[58] Field of Search ..... 426/77–79, 84, 426/112, 433; 99/295

[56] References Cited

U.S. PATENT DOCUMENTS

| | | | |
|---|---|---|---|
| 2,451,195 | 10/1948 | Brown | 426/77 |
| 2,778,739 | 1/1957 | Rodth | 426/77 |
| 2,936,695 | 5/1960 | Donot . | |
| 3,292,527 | 12/1966 | Stasse . | |
| 3,589,272 | 6/1971 | Bouladon | 426/77 |
| 3,607,297 | 9/1971 | Fasano . | |
| 4,136,202 | 1/1979 | Favre | 426/115 |
| 4,292,332 | 9/1981 | McHam | 426/118 |
| 4,846,052 | 7/1989 | Favre . | |

FOREIGN PATENT DOCUMENTS

| | | |
|---|---|---|
| 0389141A1 | 9/1990 | European Pat. Off. . |
| 1537031 | 7/1968 | France . |
| 2033190 | 12/1970 | France . |
| 2211924 | 7/1974 | France . |
| 2617389 | 1/1989 | France . |
| 314618 | 2/1934 | Italy . |
| 0458099 | 8/1968 | Switzerland . |
| 0605293 | 9/1978 | Switzerland . |
| 2023086 | 12/1979 | United Kingdom . |

OTHER PUBLICATIONS

Wiley Encyclopedia of Packaging Technology 1986 (Bakker–Editor) J. Wiley & Sons pp. 48–53, 270–275.

*Primary Examiner*—Steven Weinstein
*Attorney, Agent, or Firm*—Vogt & O'Donnell, LLP

[57] ABSTRACT

A cartridge which contains a substance for preparation of a beverage has a cover membrane member which covers an opening of a container body for containing the substance within the container interior. The body has a base and a sidewall which extends from the base to define a container interior, and the sidewall defines the opening at a position opposing the base. The membrane is affixed to a rim which extends from the sidewall in a direction away from the sidewall. An interior container surface of either the base or the cover membrane member contains a plurality of perforations which define openings which provide localized absence of a plurality of portions in the base or cover membrane member to provide a plurality of localized portions of reduced thickness so that when a fluid pressure for extraction of the substance for preparation of a beverage is applied, the localized portions of reduced thickness tear and open for beverage passage.

15 Claims, 2 Drawing Sheets

CARTRIDGES HAVING INTERIORLY POSITIONED ZONES OF REDUCED THICKNESS

CROSS-REFERENCE TO RELATED APPLICATION

This is a continuation application of application Ser. No. 07/899,342, filed Jun. 16, 1992 and now abandoned.

BACKGROUND OF THE INVENTION

This invention relates to a cartridge containing a substance for the preparation of a beverage adapted to extraction machines operating by fluid under pressure.

There are several reasons for the use of cartridges for the preparation of a beverage, above all in the field of espresso-type coffees extracted under pressure, namely, hygiene, optimal keeping of the coffee, ease of use, better control of the quality of the coffee obtained and good reproducibility of the extraction conditions. Among the variety of cartridges available, only closed cartridges which open under the pressure of the injected water satisfy the requirements mentioned above. These cartridges are distinguished by their opening system. In addition, they are substantially impermeable to moisture and preferably to oxygen.

The all-aluminium cartridge according to Swiss Patent No. 605 293 has a base face which is larger in diameter than its upper face, and because it is in the form of an inverted frustum, it is not compatible with conventional espresso-type coffee machines and accordingly requires a specifically designed extraction machine. In addition, the base face has a membrane which contains a line of weakening for tearing preferentially under the effect of pressure, but that has a disadvantage of increasing the complexity and price of the cartridge, because the materials used have to be treated with considerable precision if opening of the cartridge is to be correct and reproducible. Further, the cartridge has a thick filter to retain the coffee grounds.

Another cartridge has been designed to be used in a process in which, in a first step, artificially weakened zones are formed in the lower membrane by mechanical action and, in a second step, the capsule is opened by tearing of the artificially weakened zones under the pressure of the injected water. One such process, which is described in French Patents Nos. 1 536 031 and 2 033 190, has numerous disadvantages.

Swiss patent application No. 458 099 relates to an installation for the preparation of a beverage in which a cartridge is extracted under pressure. The cartridge, which may contain ground coffee, consists of two stiff foils of plastic or aluminium, which are perforated and welded to one another, surrounding a porous envelope, containing the substance to be extracted of which the lower face is covered with a thin film of thermoplastic material which melts in the presence of the hot extraction liquid.

SUMMARY OF THE INVENTION

The problem addressed by the present invention was to provide a closed cartridge in the form of a frustum, inverted frustum or hemisphere which would open under pressure to allow the extract to pass through and which could be extracted in conventional espresso machines by means of a simple adapter.

The package according to the invention has a body and a membrane having an artificially weakened zone which tears preferentially under the effect of fluid pressure during preparation of the beverage and which is substantially impermeable to moisture and, in particular, to oxygen.

The cartridge package of the present invention is characterized in that the body is in the form of a frustum, inverted frustum or hemisphere with a rounded cross-section and is provided with a rim, in that the membrane forms the cover of the cartridge fixed to the rim of the body and in that the membrane or the flat face of the body comprises zones of reduced thickness intended to promote opening of the cartridge for the passage of the extract under the effect of the fluid pressure.

Depending on the impermeability of the material to oxygen, the cartridge may be wrapped as such or may optionally be packed in bags which are themselves impermeable to oxygen and which allow storage for 6 to 12 months. In the latter case, the cartridges may be packed in groups, for example of 2 to 10, because—as they are closed—they themselves will keep for a few days, for example for 2 to 15 days, after the bag has been opened.

The present invention also provides a process for the production of the package in which the body of the cartridge is thermoformed or stamped from a first film, the body thus formed is filled with a powder-form beverage preparation composition in a stream of inert gas, after which the membrane, which is formed from a second film, is sealed to the body of the cartridge.

The process is characterized in that zones of reduced thickness are formed in the first film or the second film before filling of the cartridge.

DETAILED DESCRIPTION OF THE INVENTION

The cartridge of the present invention comprises two parts, namely a body and a membrane. The body is frusto-conical or hemispherical in shape or in the form of an inverted frustum. The cross-section of the body is rounded, in other words it may be circular, oval or polygonal with rounded edges. The zones of reduced thickness may be in the membrane or in the flat face of the body.

The cartridge according to the invention may be extracted with the device comprising a grill according to European patent application No. 91107462. The cartridge may also be extracted in a conventional espresso type coffee machine by means of a specific adapter such as described in the European patent applications filed on the same day as the present application under Nos. 91111210, 91111211 and 91111212.

The extraction machines according to these patent applications enable this simplified cartridge to be extracted under good conditions. The cartridge opens automatically in the extraction machine and, after use, may be withdrawn easily and integrally with a minimum of waste grounds or packaging material.

During extraction, the lower face deforms and then tears in the zones of reduced thickness on contact with the perforating tool, for example in the form of projecting elements, the lower face, which was pretreated during production to form zones of reduced thickness in its constituent material, reaching its breaking stress under the pressure of the fluid, for example air and water. Extraction of the coffee can then proceed. These zones of reduced thickness are formed in the constituent material so that it is capable of reaching the breaking stress in the extraction machine without necessitating excessive elongation despite its plastic nature. There are preferably a large number of these zones of reduced thickness uniformly distributed over the entire face.

The zones of reduce thickness may form straight dotted lines in the form of dashes, for example 2 to 10 mm in length and a few μm to a few mm in width.

The zones of reduce thickness may also form lines in the form of concentric arcs distributed around circles of variable diameter. In this case, the extraction machine intended to use these cartridges may comprise projecting elements on a flow grill in an arrangement corresponding to that of these arcs. Thus, the cartridge and the zones of reduced thickness are perfectly positioned opposite the projecting elements of the grill which are intended to promote their opening.

These zones of reduced thickness can be obtained by the local absence of an upper layer or part of an upper layer of the constituent material of the lower wall of the cartridge.

The cartridge is extracted under pressure which means that the maximum pressure of the extraction fluid is not reached during opening of the cartridge, but later during extraction when the loss of pressure through the layer of coffee has reached its maximum. In addition, the zones of reduced thickness in the lower face, which are formed solely during production of the cartridge, are not obtained by stamping of the material, but instead by separate, more dependable processes, i.e., processes with no tolerance problems.

The treatment of the lower face is even more justified in the case where the cartridge is in the form of an inverted frustum, because in that case, where the lower face is similar in thickness to the frustum, i.e., is sufficiently thick for the part to be stiff, its tearing could not normally be obtained without considerable elongation which is incompatible with the water pressures and temperatures used. In the case of a frustoconical cartridge, the situation is less critical and the membrane, which forms the lower face, can be even more reduced in thickness than the body because the membrane contributes little to the stiffness of the cartridge in this case and the pressure is applied over a larger surface.

The invention is described in more detail with reference to various embodiments of cartridges illustrated by way of example in the accompanying drawings.

DETAILED DESCRIPTION OF THE DRAWINGS

Figure 1:
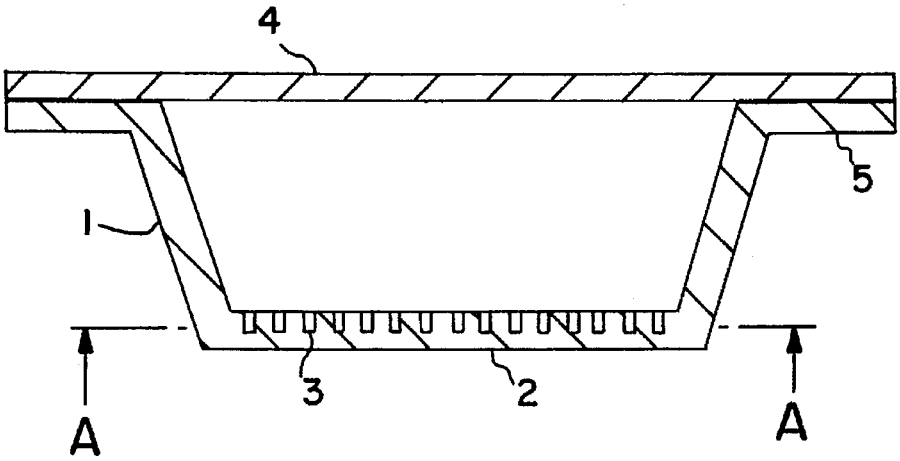
FIG. 1 is a medial diagrammatic section through a cartridge in the form of an inverted frustum.

Referring to FIG. 1, the body 1 of the cartridge comprises a flat face 2 having a face interior surface provided with a plurality of zones 3 of reduced thickness. After filling with a powder-form composition for a beverage (not shown), the cartridge is closed by a cover 4, which forms the membrane applied to the rim 5 of the body. The body 1 is thermoformed or injection-moulded, preferably from a 100 to 500 μm thick film of polyester, polyamide, or polyolefin, for example, from a 20 μm thick composite of polyethylene terephthalate bonded to a perforated or woven or nonwoven polypropylene, a perforated or woven or nonwoven polyethylene terephthalate or a perforated polyethylene. Perforation is carried out before lamination of the composite and before forming. The membrane 4 consists of a 10 to 50 μm thick film, preferably of polyester, polyamide, or polyolefin, for example a 12 μm thick silica-filled composite of polyethylene terephthalate with a polypropylene, a polyethylene terephthalate or a polyethylene. The membrane has a surface in contact with the body of the same material or of a material heat-sealable to that of the body.

Figure 2:
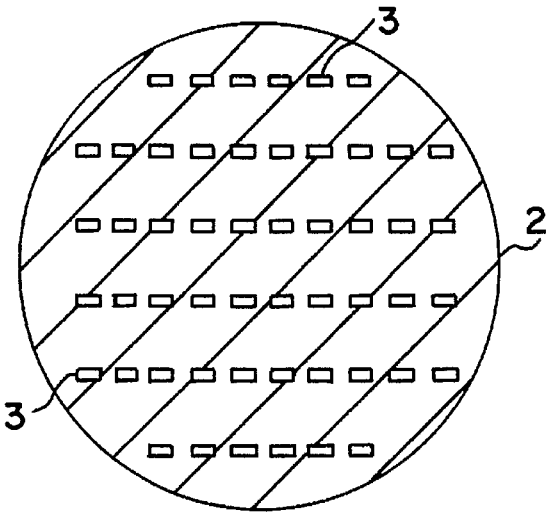
FIG. 2 is a section on the line A—A of FIG. 1.

FIG. 2 shows how the zones 3 of reduced thickness are distributed over the flat face 2 of the body 1.

Figure 3:
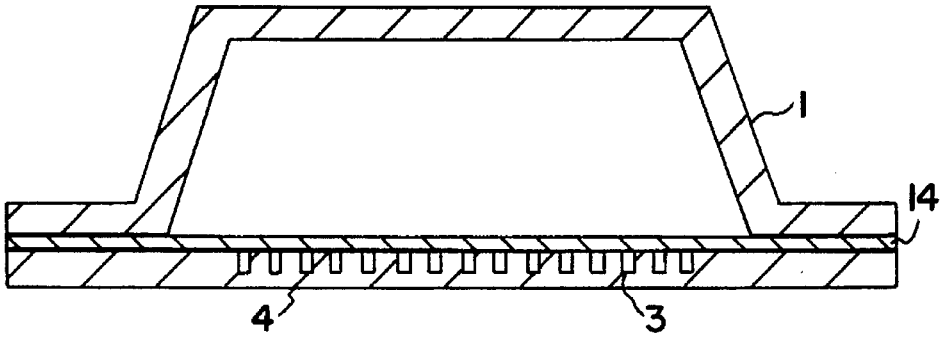
FIGS. 3 and 4 are medial diagrammatic sections through various frustoconical cartridges.

FIG. 3 shows a variant of the cartridge in the form of an inverted frustum. In this variant, the body is formed by thermoforming of a film of polyester or a polyester/polyolefin or card composite, the card weighing 200 to 300 g/m$^2$, for example, and being bonded to a layer of polyester.

In a preferred version which provided the powder-form composition for a beverage with complete protection against oxidation, the body is formed from a thin barrier film, preferably 5 to 30 μm in thickness, of polyvinylidene chloride or an ethylene/vinyl alcohol copolymer sandwiched between two layers of polyolefin, for example a multilayer film of polypropylene/ethylene-vinyl alcohol copolymer/polypropylene, polyethylene/ethylene-vinyl alcohol copolymer/polyethylene, for example between 100 and 500 μm in thickness. Alternatively, the thin barrier film may be a thin silica-filled or metallized polyester film, for example between 10 and 20 μm in thickness. The body may also be made of card, for example weighing between 200 and 300 g/m$^2$, bonded to a composite of ethylene/vinyl alcohol copolymer with a polyolefin or a polyester.

The membrane consists of a complex film, for example of-polyester filled with silica or metallized and, for example, between 10 and 20 μm in thickness, with a layer of optionally perforated or woven or nonwoven polyolefin or of optionally perforated or woven or nonwoven polyester.

Figure 4:
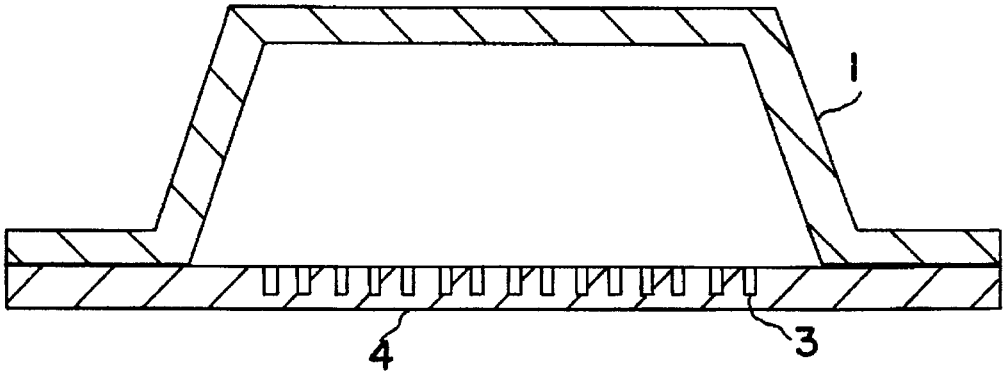

In FIG. 4, the membrane 4 is provided with a plurality of zones 3 of reduced thickness positioned in the membrane surface which faces the cartridge interior.

Figure 5:
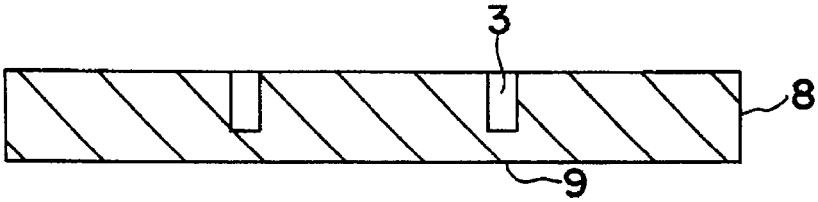
FIGS. 5, 6, 7 and 8 are partial sections showing details of the zones of reduced thickness formed in the cartridges.
Figure 6:
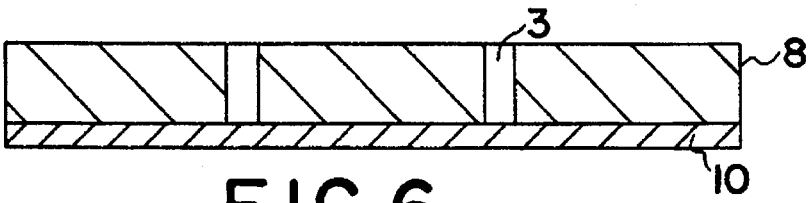

In FIGS. 5 and 6, the zones 3 of reduced thickness may be formed by perforation or cutting of the wall 8, for example with a tool provided with a plurality of small cutting blades, for example 2 to 10 mm in length, and by corresponding formation of slots throughout the thickness of the material. This operation may take place before forming of the capsule or application of the membrane, but is preferably carried out after forming for perforation of the base of the body. After perforation, a heated tool may be applied to the outer surface of the perforated film to close the slots initially formed over a minimal thickness 9, for example of 5 to 20 μm, as shown in FIG. 5. In a variant of this surface fusion which is shown in FIG. 6, a very thin film of heat-shrinkable plastic material (10, FIG. 6), for example between 5 and 20 μm in thickness, may be applied around the entire perforated cartridge. In this particular embodiment, the constituent material of the cartridge may be aluminium and the thin film 10 may be aluminized.

Figure 7:
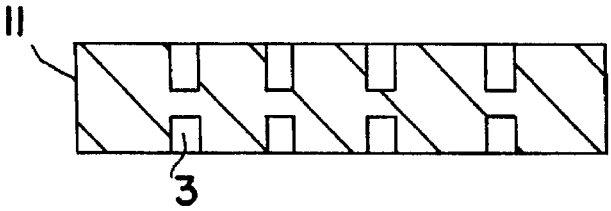

In FIG. 7, the body of the cartridge or the membrane is thermoformed in such a way that the lower wall of the cartridge has a grooved lower face of uniform thickness between a die and a cavity block which is grooved to form ribs, after which a blank of the cartridge is placed in an identical cavity block, but with a heated and similarly grooved die and of which the ribs correspond to those of the cavity block. The pressure of the die against the cavity block produces a significant reduction in the thickness of material, such as in the zones 3 where the ribs of the tools correspond. In the grooves between the ribs, the wall 11 retains its initial thickness.

Figure 8:
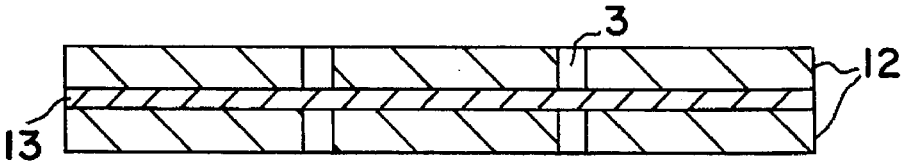

In FIG. 8, the multilayer film comprises thick and resistant structure layers 12 which have been locally torn or cut or which may even be in the form of a cloth or unwoven structure of plastic material. These structure layers are bonded to a thin oxygen-impermeable layer 13.

In all the versions of cartridges described in this specification, the cartridge according to the invention may vary in size according to the desired volume of beverage. For example, the dose of coffee may vary between 5 and 20 g, the diameter of the cartridge is between 2.5 and 7 cm and the thickness of the layer of coffee is between 10 and 25 mm.

The cartridge is filled with a powder-form composition for the preparation of a beverage. This substance is preferably roasted and ground coffee, but may also be tea, soluble coffee, a mixture of ground coffee and soluble coffee or a chocolate-flavoured product.

The cartridge is adapted to the extraction machine comprising a tool for perforating the upper and lower faces of the cartridge during extraction. The zones of reduced thickness are situated in the lower face (for example as shown in FIGS. 1 and 3) which facilitates perforation. In every case, the extraction fluid will be directed in a vertical stream to pass through the entire layer of powder-form composition without any danger of lateral flow paths being created.

In order completely to eliminate the risk of dispersion of grounds after extraction, a layer of filter paper or woven or nonwoven synthetic fibres may be provided between the substance to be extracted and the lower inner wall of the cartridge (as shown in FIG. 3, reference numeral 14). This layer may optionally be bonded to the wall.

I claim:

1. A cartridge container containing a substance for preparation of a beverage comprising:

a body comprising a base, a sidewall and a rim, wherein the sidewall extends from the base to define a container interior, to define a container opening which opposes the base and to define a body shape selected from the group consisting of a frustum and a hemisphere and wherein the sidewall extends from the base to the rim and the rim extends from the sidewall in a direction away from the sidewall;

a cover membrane member affixed to the rim to cover the opening;

a substance for preparation of a beverage contained within the container interior by the body and cover membrane member; and wherein the base defines both a container base outer solid surface and a container base interior surface and wherein the container base contains a plurality of perforations which define openings in the base which extend for a distance from the container base interior surface through the base towards the container base outer solid surface to provide localized absence of a plurality of portions of the base so that the base has a plurality of zones which comprise a plurality of localized portions of reduced thickness and so that when a fluid pressure for extraction of the substance for preparation of a beverage is applied, the localized portions of reduced thickness tear and open for beverage passage.

2. A cartridge container containing a substance for preparation of a beverage comprising:

a body comprising a base, a sidewall and a rim, wherein the sidewall extends from the base to define a container interior, to define a container opening which opposes the base and to define a body shape selected from the group consisting of a frustum and a hemisphere and wherein the sidewall extends from the base to the rim and the rim extends from the sidewall in a direction away from the sidewall;

a substance for preparation of a beverage contained within the container interior; and a cover membrane member affixed to the rim to cover the opening and to contain the substance in the container interior and wherein the cover member defines both a container cover member outer solid surface and a container cover member interior surface and wherein the container cover member contains a plurality of perforations which define openings in the container cover member which extend for a distance from the container cover member interior surface through the container cover member towards the container cover member outer solid surface to provide localized absence of a plurality of portions of the cover membrane member so that the cover membrane member has a plurality of zones which comprise a plurality of localized portions of reduced thickness and so that when a fluid pressure for extraction of the substance for preparation of a beverage is applied, the localized portions of reduced thickness tear and open for beverage passage.

3. A cartridge container according to claim 1 or 2 wherein the body has a shape of a frustum.

4. A cartridge container according to claim 1 or 2 wherein the cartridge container is substantially impermeable to moisture and oxygen.

5. A cartridge container according to claim 1 or 2 wherein the plurality of zones of the localized portions of reduced-thickness are in a form of dashes and are arranged in a plurality of straight lines.

6. A cartridge container according to claim 1 or 2 wherein the plurality of zones of the localized portions of reduced-thickness are arranged in a plurality of concentric arcs.

7. A cartridge container according to claim 1 wherein the base comprises layers of material and wherein a first layer forms the container base outer solid surface, a second layer forms the container base interior surface and the perforations extend through the second layer to provide openings therethrough.

8. A cartridge-container according to claim 7 wherein the second layer comprises a material selected from the group consisting of polyethylene, polypropylene and polyethyleneterephthalate.

9. A cartridge container according to claim 1 further comprising a layer of filter paper positioned adjacent the container base interior surface.

10. A cartridge container according to claim 2 wherein the container cover member comprises layers of material and wherein a first layer forms the container cover member outer solid surface, a second layer forms the container cover member interior surface and the perforations extend through the second layer to provide openings therethrough.

11. A cartridge container according to claim 10 wherein the second layer comprises a material selected from the group consisting of polyethylene, polypropylene and polyethyl-eneterephthalate.

12. A cartridge container according to claim 2 further comprising a layer of filter paper positioned adjacent the container cover member interior surface.

13. A cartridge container containing a substance for preparation of a beverage comprising:

a body comprising a base member, a side-wall and a rim, wherein the sidewall extends from the base member to define a container interior, to define a container opening which opposes the base and to define a body shape selected from the group consisting of a frustum and a hemisphere and wherein the sidewall extends from the base to the rim and the rim extends from the sidewall in a direction away from the sidewall;

a cover member affixed to the rim to cover the opening;

a substance for preparation of a beverage contained within the container interior by the body and cover membrane; and wherein one of the base member or the cover member defines one container outer surface and one container interior surface and wherein the one member contains a plurality of perforations which define opposing openings in each of the outer and interior surfaces and wherein the openings extend for a distance from each surface through the one member towards a member solid portion positioned between the outer and interior surfaces to provide localized absence of a plurality of portions of the one member and an intermediately positioned member solid portion so that the one member has a plurality of zones which comprise a plurality of localized portions of reduced thickness and so that when a fluid pressure for extraction of the substance for preparation of a beverage is applied, the localized portions of reduced thickness tear and open for beverage passage.

14. A cartridge according to claim 13 wherein the one member comprises layers of material and wherein a first layer forms the outer surface, a second layer forms the interior surface and the perforations extend through the first and second layers to provide openings therethrough and a third layer forms the intermediately positioned solid portion.

15. A cartridge according to claim 13 or 14 wherein the one member is the cover member.

* * * * *